US006103060A

United States Patent [19]

Munerelle et al.

[11] Patent Number: 6,103,060

[45] **Date of Patent: *Aug. 15, 2000**

[54] METHOD FOR MANUFACTURING A SHEET OF PAPER OR NON-WOVEN IN A FOAM MEDIUM USING A NONIONIC SURFACTANT

[75] Inventors: Corinne Munerelle, Colmar, France; Frank D. Harper; Gary L. Schroeder, both of Neenah, Wis.; Antony D. Awofeso; Henry S. Ostrowski, both of Appleton, Wis.

[73] Assignee: Fort James France, Kunheim, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/682,722

[22] PCT Filed: Feb. 1, 1995

[86] PCT No.: PCT/FR95/00118

§ 371 Date: Oct. 28, 1996

§ 102(e) Date: Oct. 28, 1996

[87] PCT Pub. No.: WO95/21299

PCT Pub. Date: Aug. 10, 1995

[30] Foreign Application Priority Data

Feb. 1, 1994 [FR] France ..... 94 01085

[51] Int. Cl.[7] ..... D21H 21/08

[52] U.S. Cl. ..... 162/101; 162/158; 162/164.3; 162/164.6

[58] Field of Search ..... 162/101, 175, 162/164.3, 164.6, 188

[56] References Cited

U.S. PATENT DOCUMENTS

| | | | |
|---|---|---|---|
| 3,007,840 | 11/1961 | Wilcox | 162/101 |
| 3,716,449 | 2/1973 | Gatward et al. | 162/101 |
| 3,837,999 | 9/1974 | Chung | 162/101 |
| 4,443,297 | 4/1984 | Cheshire et al. | 162/101 |
| 4,488,932 | 12/1984 | Eber et al. | 162/101 |
| 5,178,729 | 1/1993 | Janda | 162/101 |
| 5,409,572 | 4/1995 | Kershaw et al. | 162/101 |

FOREIGN PATENT DOCUMENTS

| | | | |
|---|---|---|---|
| 1329409 | 9/1973 | United Kingdom | 162/101 |

*Primary Examiner*—Peter Chin
*Attorney, Agent, or Firm*—Breiner & Breiner

[57] ABSTRACT

The object of the invention is a method for manufacturing in a foam medium a sheet of paper or non-woven. In the invention, the surfactant used to form the foam is a nonionic compound of an ethoxylated alcohol of the Formula I:

$$R—(OCH_2CH_2)_n—OH \quad (I)$$

wherein n is an integer from 2 to 22 and R is a linear or branched alkyl group having 6 to 20 carbon atoms or where R is in the form of R'—X wherein X is an aromatic nucleus and R' is a linear or branched alkyl group having 2 to 16 carbon atoms. In particular, the invention applies to making household papers such as paper towels.

9 Claims, 4 Drawing Sheets

AOS
SN-120
WATER PROCEDURE
320
300
280
260
240
220
cN
2.7
3.6
4.5
5.4
6.3
7.2
8.1
kg/T Kymene 557H (WET TENSILE STRENGTH)

PAPER MADE WITH AOS
PAPER MADE WITH SN-120
PAPER MADE IN A WATER MEDIUM
INITIAL ABSORBENCY RATE (g/g/s ½)
0.30
0.28
0.26
0.24
0.22
0.20
0.18
200
400
600
800
1.000
GEOMETRIC MEAN OF DRY TENSILE STRENGTH

METHOD FOR MANUFACTURING A SHEET OF PAPER OR NON-WOVEN IN A FOAM MEDIUM USING A NONIONIC SURFACTANT

The present invention is directed to a method for manufacturing a paper or non-woven sheet in a foam medium.

The invention applies to the paper industry for making paper or non-woven sheets for domestic, household or sanitary uses. With regard to these applications, the desired properties in the sheet of paper or non-woven are softness, dry or wet strength, absorption, specific volume, and the like. A balancing between these various properties is necessary. Finished products made using known procedures for making paper in a foam medium preclude optimizing all of the desired properties.

The expression "foam medium" as used herein denotes a wet manufacturing method for paper or non-woven sheets wherein the water is replaced by an aqueous solution containing a foam-generating surfactant.

European Patent Application No. 481,746 of James River Corp. of Virginia, U.S.A. describes a manufacturing procedure for foam-medium papermaking. The procedure consists in preparing a fabrication composition in the form of a foaming fiber dispersion by mixing a suspension of fibers in water with a foaming liquid comprising a surfactant. Further described in forming a fiber layer on a papermaking machine, is the recovery of the foaming liquid, recycling part of the foaming liquid to prepare the manufacturing composition, and the treating of a part of the recovered foaming liquid by separating the surfactant from the liquid. Many surfactants can be used. Suitable surfactants include anionic, cationic or nonionic surfactants to form the fiber layer and some amphoteric surfactants. U.S. Pat. Nos. 3,716,449 and 3,871,952 describe anionic, cationic and nonionic surfactants.

Cationic surfactants, such as lauramine oxide, are not used because they are adsorbed on the anionic sites present in the paper pulp used in making household paper.

On the other hand, among the various anionic surfactants, the α-olefin sulfonates (AOS) have been found to be particularly suitable for evincing optimal industrial performance, namely as being highly foaming, retaining much gas (air), i.e., about 60%-volume for the foam generated by the surfactant, and lacking toxicity.

Other known nonionic surfactants have been found to be less effective than the above anionic surfactant with regard to processing, i.e., recovery rate, surfactant enrichment and the like.

However, major disadvantages are present in using the anionic α-olefin-sulfonates of the prior art where cationic additives are needed to improve certain paper properties such as softness and tear-strength in the moist or dry state. One problem which arises when a cationic substance is added during a foaming procedure using an anionic surfactant, in this case an AOS, is that the anionic and cationic compounds chemically react with each other and thus lose effectiveness. The added cationic substance loses effectiveness and the surfactant loses gas in the formed foam thereby requiring the addition of substantial quantities of AOS to the foaming liquid. On account of its softening properties, excessive incorporation of AOS results in a product which in the dry state is too weak. In turn this requires more pulp refining or the inclusion of other additives, such as modified starch, to remedy the loss in strength.

An object of the present invention is to palliate the above noted disadvantages encountered when using AOS as a surfactant while retaining its advantageous performance with respect to its method of use and the advantageous properties, mechanical and other, which are provided in the final product made by the method.

Another object of the present invention is to employ cationic additives without incurring chemical incompatibility with the surfactant utilized, i.e., the additives will not react with the surfactant.

Another object of the present invention is to create a method providing improved surfactant consumption and improved recovery of the surfactant in recycling relative to the procedures using a foaming medium of the prior art.

Yet another object of the present invention is to create a method which, in the presence of cationic additives, improves the softness and other properties of the sheet made by the method, including in particular, dry or wet tensile strength and rate of water absorption.

Another object of the present invention is the provision of a manufacturing method in a foam medium for a non-woven or paper sheet wherein the method uses a nonionic compound of the ethoxylated alcohol-type of Formula I below as a surfactant:

$$R—(OCH_2CH_2)_n—OH \quad (I)$$

wherein n is an integer from 2 to 22 and R is a linear or branched alkyl group having from 6 to 20 carbon atoms or where R is R'—X wherein X is an aromatic nucleus and R' is a branched or linear alkyl group having from 2 to 16 carbon atoms.

In a preferred embodiment of the invention, n varies in the range from 4 to 20 and R is a linear alkyl group having from 8 to 16 carbon atoms.

In another preferred embodiment of the invention, the method includes incorporating cationic additives used in papermaking as softeners, dry tensile strength improvers, wet tensile strength improvers, and/or dispersing agents.

Other features and advantages of the invention are further elucidated below in the detailed description and drawings of the invention.

Figure 6:
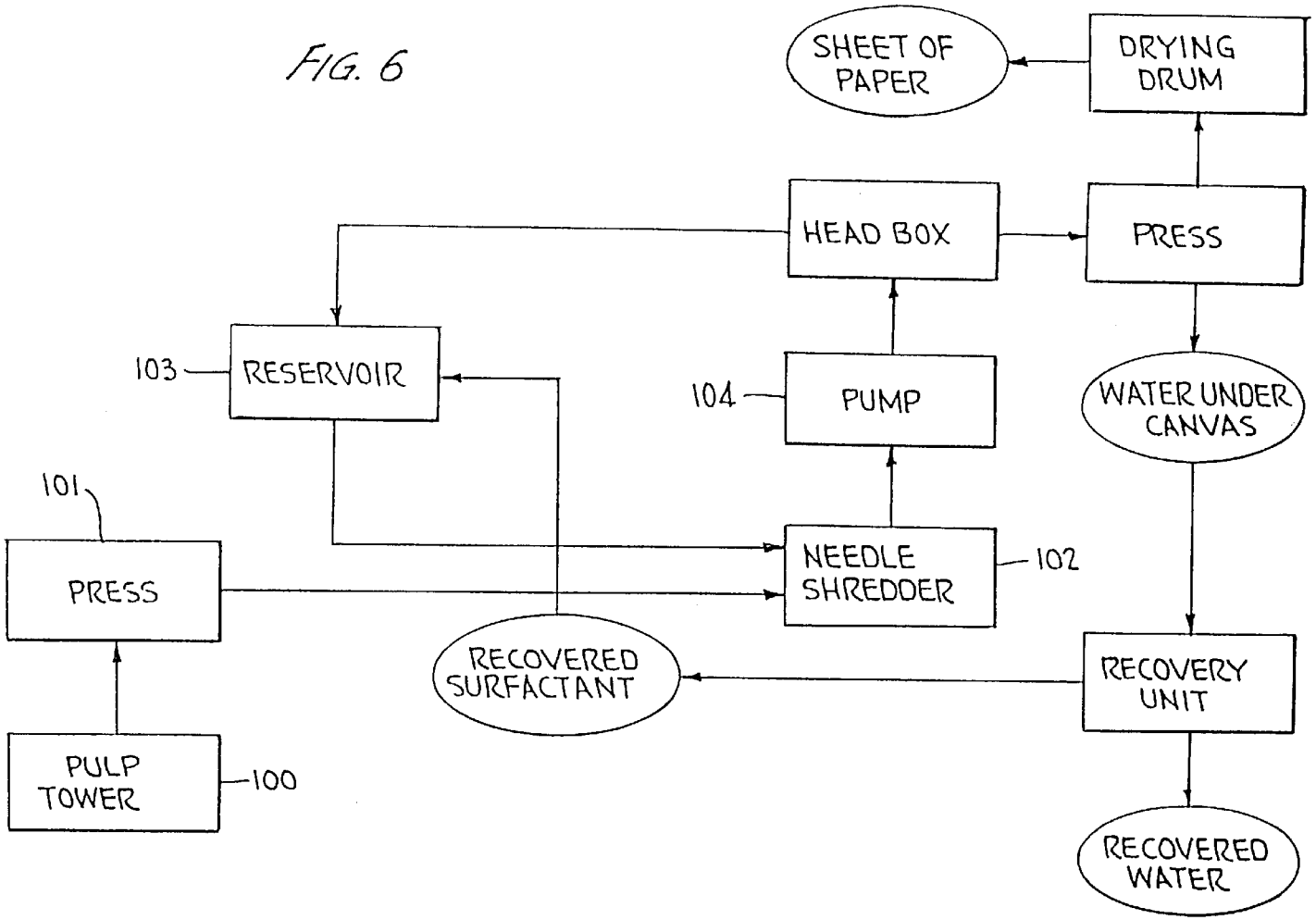

FIG. 6 is a block diagram showing a variation of the papermaking method described in U.S. Pat. No. 5,200,035.

In the description below, the expression "dry strength" and "wet strength", respectively, denote the tensile strength at the point of rupture in the dry and wet states.

The nonionic surfactant employed in the invention is an ethoxylated alcohol of the general Formula I $$R—(OCH_2CH_2)_n—OH \quad (I)$$

as described above. The compound is prepared by condensing ethylene oxide and an alcohol, a phenol or another molecule having volatile hydrogen. Such compounds are known as polyethylene glycol ethers. Surfactants of this kind were tested and are described herein to provide illustrative examples of the invention.

A preferred surfactant is the commercially available product WITCONOL® SN-120 made by Witco Corp., Houston, Tex., U.S.A. This surfactant is within Formula I wherein n is between 4 and 20 and R a linear alkyl group having 8 to 16 carbon atoms. Type FAB mass spectrometry was used to identify the ethoxylated group of this compound. The spectrum conclusively shows that the ethoxylation range is from 4 to 20 ethoxy groups with a peak at about 8 to 9 groups. Liquid chromatography was used to measure the distribution of this compound's alkyl chains. This is not a gaussian distribution. This technique proves that WITCONOL® SN-120 is particular by lacking $C_6$ and $C_8$ alkyl chains which are the most irritative. The compounds comprising the $C_6$ and $C_8$ alkyl chains were found to be irritants in rabbit eye tests. The alkyl chains are distributed as follows:

$C_8$ chain=2.0% maximum $C_{10}$ chain=83–89%

$C_{12}$ chain=5–9%

$C_{14}$ chain=3–7%

$C_{16}$ chain=0.5% maximum.

Another advantageous feature of WITCONOL® SN-120 is that it has a toxicity lower than the α-olefin-sulfonates (AOS). The lethal dose LC50 for tested aquatic species is at least twice as high as for WITCONOL® SN-120 than for AOS. Moreover, this surfactant is sanctioned both in Europe and the U.S.A. for making papers exposed to food contact, such as paper towels.

Preferably, WITCONOL® SN-120 is used as a mixture of 20% water and 80% pure compound in order to be liquid at ambient temperature. Such a mixture is sold as WITCONOL® SN-120D.

Another illustrative nonionic surfactant which is encompassed within Formula I is sold as WITCONOL®NP-130 by Witco Corp., Houston, Tex., U.S.A. This composition is an ethoxylated nonylphenol. It is within Formula I wherein n ranges from 4 to 21 and R is R'—X wherein X is a phenyl group and R' is a branched alkyl group having 9 carbon atoms. The main nonyl isomer is of Formula II as set forth below:

(II)

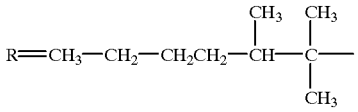

Another nonionic surfactant useful in the present invention is the commercially available product DESONIC® 12-8. This compound is sold by Witco Corp. and also is an ethoxylated alcohol. It differs from WITCONOL® SN-120 solely by the length distribution of the carbonaceous chains. In DESONIC@12-8, the largest proportion is the $C_{12}$ chain which is present by about 90%, whereas in WITCONOL® SN-120, it is the $C_{10}$ chain which is the largest.

The cationic agents used in the present invention are softeners. Further substances for improving wet or dry strength, or substances for improving mechanical properties can also be used.

Suitable softeners are illustrated in the description set forth below by quaternary amines as exemplified in Formula III:

(III)

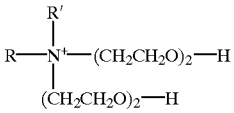

wherein R and R' are alkyl groups having 10 to 14 carbon atoms. This additive is sold under the tradename BEROCELL® 595 and is used as a softener in papermaking. Hereafter BEROCELL® is called BEROL.

Substances for improving wet or dry strength are cationic additives, and more specifically, polycationic additives. Among them, KYMENE® 557 H is presently used in papermaking to increase the wet strength of paper sheets. This product is obtained by reacting epichlorohydrin with a condensation poly(aminoamide) from adipic acid and diethylene triamine. Most likely the cationic sites are formed by converting a primary amine function affixed to the polyamine chain and results from the reaction of diethylene triamine which reacts with the epichlorohydrin as discussed in "The Structure Of KYMENE", Matiur Rahman, Teepak Inc. 1991, Non-Woven Conference, pp. 299–303.

A cationic agent for improving the dry strength is shown in the following text in the form of a quaternary cationic starch ether commercially sold under the tradename SOLVITOSE® N.

In a first stage, the nonionic surfactants of Formula I were tested to show their foaming properties were at least as good as those of the α-olefin-sulfonate (AOS) surfactant and that they produce paper specimens evincing mechanical properties at least equal to those made using AOS.

In the tests described below, use is made of WITCONOL® SN-120 as the surfactant to carry out the method of the invention, and the test specimens made by this method are compared with specimens made in a foaming medium using AOS and with control specimens made conventionally in a water medium. Moreover, it has been found possible to incorporate cationic additives such as BEROL, or a cationic substance, namely SOLVITOSE® N, to compensate for the drop in tensile strength entailed by adding BEROL which softens and loosens (debonds) tissue structures.

The tests were conducted using a paper composition consisting of a 50/50 mixture of disintegrated eucalyptus pulp and a pulp containing resin refined for 30 minutes in a Valley beater.

Regarding the tests covering the incorporation of the softener BEROL, it is added in a proportion of 2 kg per ton of dry pulp. Following a contact time of about 15 minutes between this component and the paper mixture, the whole is diluted in order to achieve a concentration of about 5 g/l. When SOLVITOSE® N (SOLVITOSE in Table I below) is added, it is added at the rate of 7 kg per ton of pulp.

A foam is prepared in the method of the invention by using WITCONOL® SN-120 (SN-120 in Table I below) which is added at a rate of 200 ppm and is 100% active. In the control procedure, AOS is used at a concentration of 200 ppm. The AOS component is only 40% active.

The foam is made using a continuous foamer of the ERNST BENZ type. A mixture of water and surfactant in a concentration of 200 mg/l is fed into the foamer. The foam so made evinces a 60%-volume of air.

In order to prepare a paper specimen with a specific density of 25 g/m$^2$, the pulp is mixed in a mixer at a concentration of 5 g/l for a short time, namely 1 to 2 seconds, with two liters of foam. Then the paper mixture holding the foam is used to produce the test specimen in accordance with the standard NF Q50-002 on a FRANK-type former.

The tests were carried out following a conditioning period of at least 48 hours at 23° C. and at an ambient humidity of 50%. The specific density, thickness, and specific volume of each specimen, as well as the dry tensile strength at rupture were measured, thereby determining the force of rupture, elongation and length of rupture.

Table I below shows the various measured parameters of thickness, specific volume, and rupture.

TABLE I

| Manufacturing method of specimen | Surfactant | Additive(s) | Specific density ($g/m^2$) | Thickness (mm) |
|---|---|---|---|---|
| water | — | — | 25.1 ± 0.2 | 47.7 ± 0.8 |
| foam | AOS | — | 25.3 ± 0.4 | 51.0 ± 1 |
| foam | SN-120 | — | 25.3 ± 0.5 | 51.4 ± 1 |
| water | — | BEROL | 25.2 ± 0.6 | 48.5 ± 1.2 |
| foam | SN-120 | BEROL | 25.0 ± 0.4 | 51.3 ± 1.6 |
| water | — | SOLVITOSE | 25.0 ± 0.5 | 46.5 ± 1 |
| foam | SN-120 | SOLVITOSE | 25.1 ± 0.3 | 50.8 ± 1 |
| water | — | BEROL + SOLVITOSE | 25.2 ± 0.2 | 48.4 ± 0.8 |
| foam | SN-120 | BEROL + SOLVITOSE | 25.2 ± 0.3 | 51.2 ± 0.9 |

| Manufacturing method of specimen | Specific volume ($cm^3/g$) | Force of rupture (cN) | Elongation at rupture (%) | Length of rupture (m) |
|---|---|---|---|---|
| water | 1.9 | 1384 ± 81 | 1.6 | 3676 ± 214 |
| foam | 2.02 | 896 ± 59 | 1.2 | 2361 ± 163 |
| foam | 2.03 | 970 ± 53 | 1.3 | 2556 ± 168 |
| water | 1.92 | 1101 ± 61 | 1.2 | 2913 ± 158 |
| foam | 2.05 | 715 ± 64 | 1.2 | 1907 ± 144 |
| water | 1.86 | 1585 ± 55 | 2 | 4227 ± 114 |
| foam | 2.02 | 1097 ± 62 | 1.7 | 2914 ± 171 |
| water | 1.92 | 1439 ± 80 | 1.7 | 3807 ± 208 |
| foam | 2.03 | 898 ± 87 | 1.4 | 2376 ± 220 |

Table I shows that WITCONOL® SN-120 lends itself to complete substitution for AOS without entailing any changes in the mechanical properties of the specimens. The properties of the specimens made using the surfactant WITCONOL® SN-120 are at least as good as those of the specimens made using AOS.

The effect of the softener additive BEROL is evident also when using the surfactant WITCONOL® SN-120. The softening effect of BEROL causes a loosening effect entailing fewer interactions between fibers and hence a decrease in rupture length of 25% in the present invention.

Table I does not show test results regarding the joint use of BEROL and AOS. Because the anionic surfactant reacts with the cationic additive, this procedure is industrially inapplicable.

The joint use of the cationic additive SOLVITOSE® N and the nonionic surfactant is, however, quite compatible and the expected result, namely increase in strength, is in fact achieved.

Lastly, the combination of WITCONOL® SN-120, BEROL and SOLVITOSE® N was tested. The results show that SOLVITOSE® N easily compensates for the loss of dry strength and where called for can be industrially added to make up for this loss in order to achieve a good balance between the properties of softness and rupture strength of the sheet of paper.

Other advantageous features of the method of the invention are evinced on an industrial scale when the method of the invention is implemented. This method is highly significant regarding the economy of use of surfactant, the recycling of the foaming liquid and the recovery of the surfactant. Moreover, the sheet of paper made by this method offers another significant property, namely softness.

European Patent Application No. 481,746 describes a foaming procedure which is one of those applicable to the present invention and is summarized below. The invention is not to be restricted to this mode of use and any other implementation method of papermaking in a foam medium is also suitable for use.

In the method illustratively described herein, the papermaking machine 10 is a "crescent-type" former as described in U.S. Pat. No. 3,326,745. The sheet-forming moist part comprises a liquid-permeable felt 11 and a canvas 12 of the kind used in making non-wovens. The canvas 12 is supported on rollers 18 and 19 so arranged together with the head roller 15 so that canvas 12 is made to converge on felt 11 in the vicinity of the head roller at an accurately determined angle relative to the felt 11. Felt 11 and canvas 12 move in the same direction, at the same speed and in the direction of rotation of the head roller 15.

In this apparatus, the canvas 12 and felt 11 converge at the upper surface of the head roller 15 and subtend a space inside which is projected a jet of foaming fiber dispersion from the headbox 20. Furthermore, a system of multiple-jets, i.e., double or triple jets, can be provided to make laminates.

The canvas 12 is tensioned in such a manner that it will pass above the felt 11 on the surface of the head roller 15 while the foaming fiber dispersion is being pressed between the canvas 12 and felt 11 to force the liquid through the canvas 12 into a container 22 where the foaming liquid is recovered. The sheet formed in this procedure is conveyed by felt 11 to a suction press 16 where it is transferred to a cylinder 26 of a drying cylinder. The sheet constituting the paper is dried and then creped with a blade 27. The paper is recovered on take-up cylinder roll 28. Part of the surfactant used in preparing the foaming liquid remains in the manufactured paper.

The foaming liquid is a solution containing the surfactant and is prepared and stored in a reservoir 30. To initiate foam formation, water is supplied through a conduit 31 to reservoir 30. Preferably, the surfactant concentration in the foaming liquid at the headbox is in the range of from approximately 100 to 350 ppm weight.

The gas content, in this instance air, preferably is about 55 to 75%-volume for the foam formed from the nonionic surfactant of Formula I for the overall method and, in particular, at the headbox.

The paper pulp from vat 36 is supplied with the foaming liquid of the headbox 20 through a conduit 33 using a positive displacement pump 32.

Foam formation takes place when the projected manufacturing composition from the headbox enters the canvas 12 and felt 11 at the upper side of the head roller 15.

The pressure from the canvas 12 on felt 11 and the force from the projected liquid force the foaming liquid through the canvas 12 into container 22.

The forces generated by the approach of canvas 12 toward felt 11, namely the linear speed and the force of the jet on canvas 12, result in the compressing and shearing of the liquid and are sufficient to entrain air into the canvas and its interstices to thereby generate the foam holding from 55 to 75%-volume of air.

The foaming liquid recovered in container 22 is recycled through conduit 28 into reservoir 30 which holds the foaming liquid. The excess of foaming liquid recovered in the container 22 is moved through a conduit 42 into a liquid-separation unit 45. Decantation takes place in a separation unit 45 and results in recovery of a foaming phase enriched with surfactant and separated and recovered through a conduit 47 from the foaming liquid fed into the liquid-separation unit 45. Thereupon, a liquid phase lean in surfactant is separated from the foam phase enriched in surfactant and is recovered through conduit 56.

At the exit of separation unit 45, the foam phase enriched in surfactant is broken in unit 48 and then recycled in reservoir 30 to prepare the manufacturing composition.

The lean surfactant liquid phase at the exit of the liquid-separation unit 45 is moved through conduit 56 to a surfactant-recovery unit.

Foaming liquid also is recovered during draining in the course of manufacturing the fiber sheet at the suction press 16 or at the suction box 84 using a collector 82. This foaming liquid then is fed through conduit 56 into the surfactant-recovery unit 55, the conduit 86 joining the conduit 56 which is supplying already lean surfactant liquid from the liquid-separation unit 45.

The unit 55 comprises specific means 60 to supply gas or air to generate foam from the foaming liquid fed into the separation unit 55. This means, i.e., aerators 60, are the kind described in European Patent Application No. 481,746 by James River Corp., Virginia, U.S.A.

The formed foam is recovered through conduit 64 and broken in unit 65, whereupon the surfactant is recycled through conduit 51 into reservoir 30.

The resulting liquid is even leaner in surfactant and is recovered in conduit 68 and can be treated again in another surfactant recovery unit 69 in cascade with the first one. From two to six recovery units can be cascaded.

The method of the invention was tested at high speed in the above-described method of implementation on a test apparatus. This apparatus has the configuration of a crescent-former. One surfactant recovery unit was used. The foaming liquid recovered from felt drainage is moved into the surfactant recovery unit.

In a first stage, the nonionic surfactants of Formula I were checked to determine that they performed well in the foaming-medium procedure. In these tests, WITCONOL® SN-120 was used as the nonionic surfactant in the method of the invention. AOS and water were used as controls in the methods using foam and water media respectively. Using WITCONOL® SN-120 and AOS, different refining degrees and different concentrations of KYMENE® 557 H were tested in the foam-medium procedures. The WITCONOL® SN-120 concentration in the headbox was about 225 ppm.

From visual examination of the bubble sizes, the foam made using WITCONOL® SN-120 looked similar to that made using AOS.

The paper-sheet formation using the WITCONOL® SN-120 procedure is similar to that of the sheet made using the AOS procedure.

Figure 1:
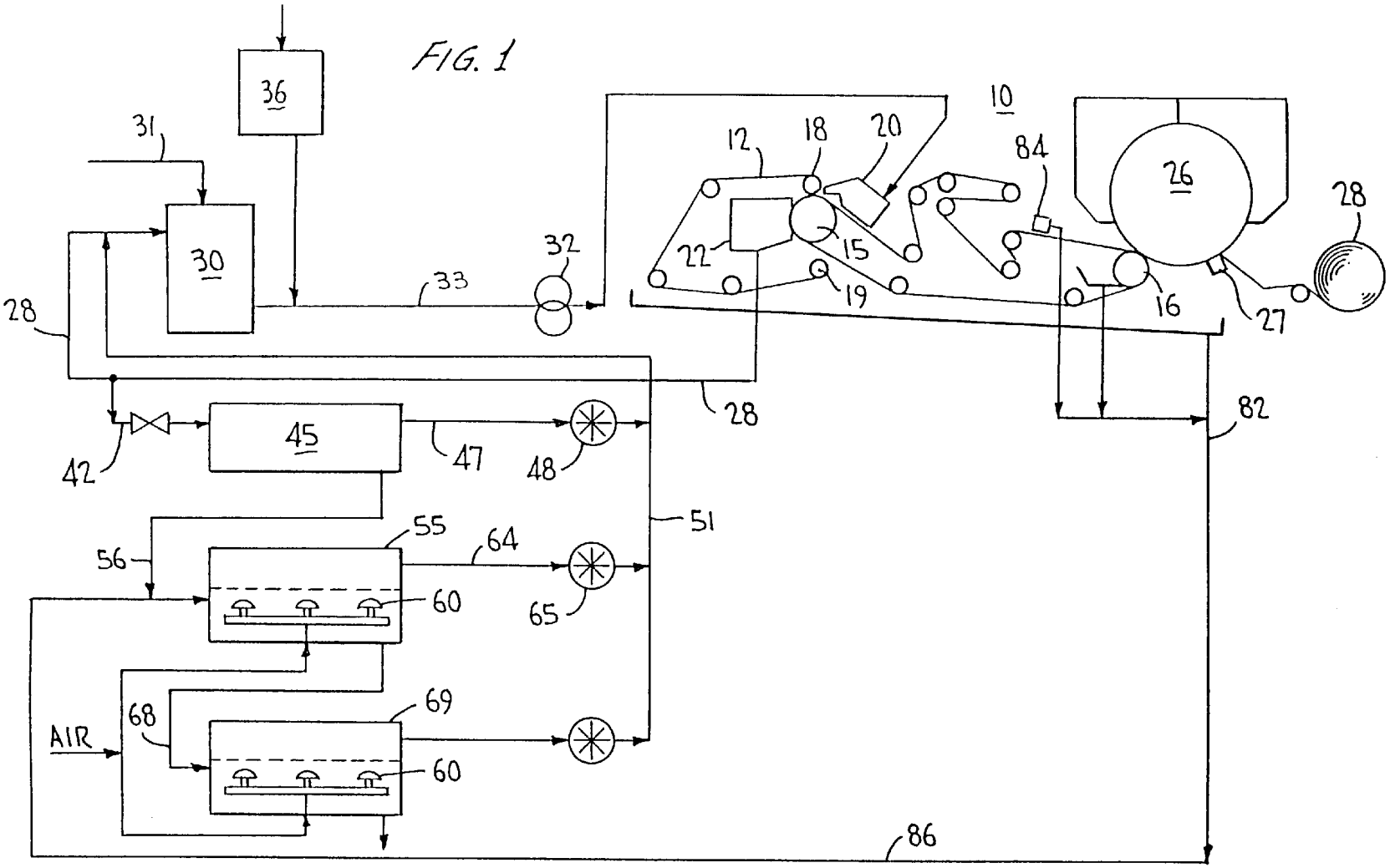
FIG. 1 is a schematic of apparatus useful in carrying out the method of the invention in one embodiment mode, and is a simplified version of FIG. 1 of European Patent Application No. 481,746.
Figure 2:
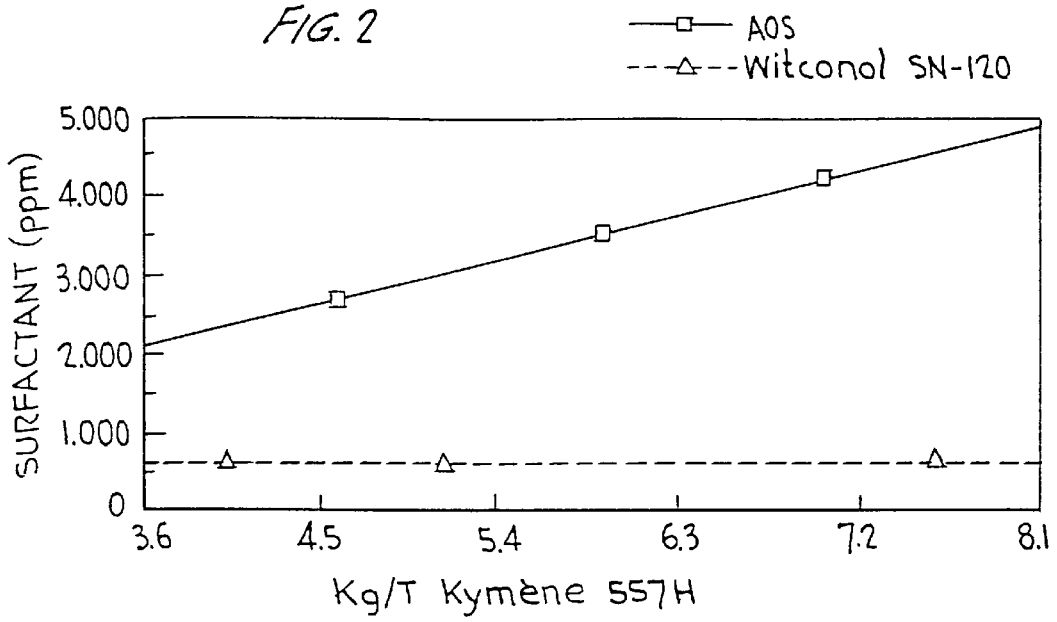
FIG. 2 shows a graph of required surfactant consumption to maintain the quantity of air constant in relation to the quantity of added cationic additive.

FIG. 2 shows the surfactant concentration as a function of the quantity of added KYMENE per ton of pulp when manufacturing paper towels. It was found that there is no interaction at all between WITCONOL® SN-120 and KYMENE.

Figure 3:
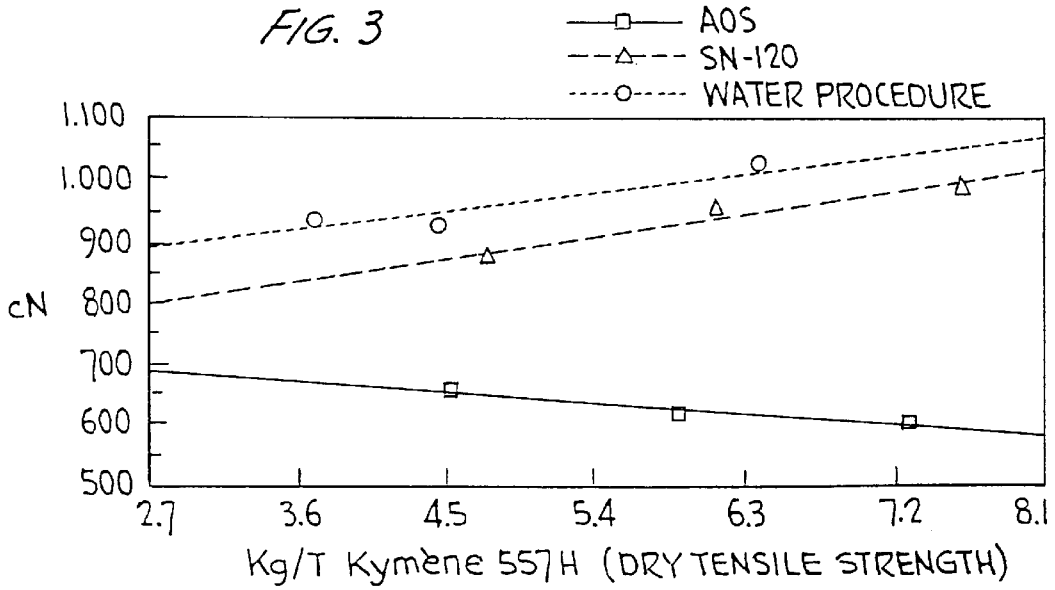
FIG. 3 shows a graph of the tensional strength (at rupture) of a dry sheet as a function of the amount of added cationic additive for various surfactants.

Moreover, higher dry strengths were achieved using WITCONOL® SN-120 in the method of the invention relative to the procedure employing AOS. This is shown by the curve of FIG. 3 where the dry-state tear resistance of the sheet is a function of the added quantity of KYMENE® 557 H per ton of pulp.

Figure 4:
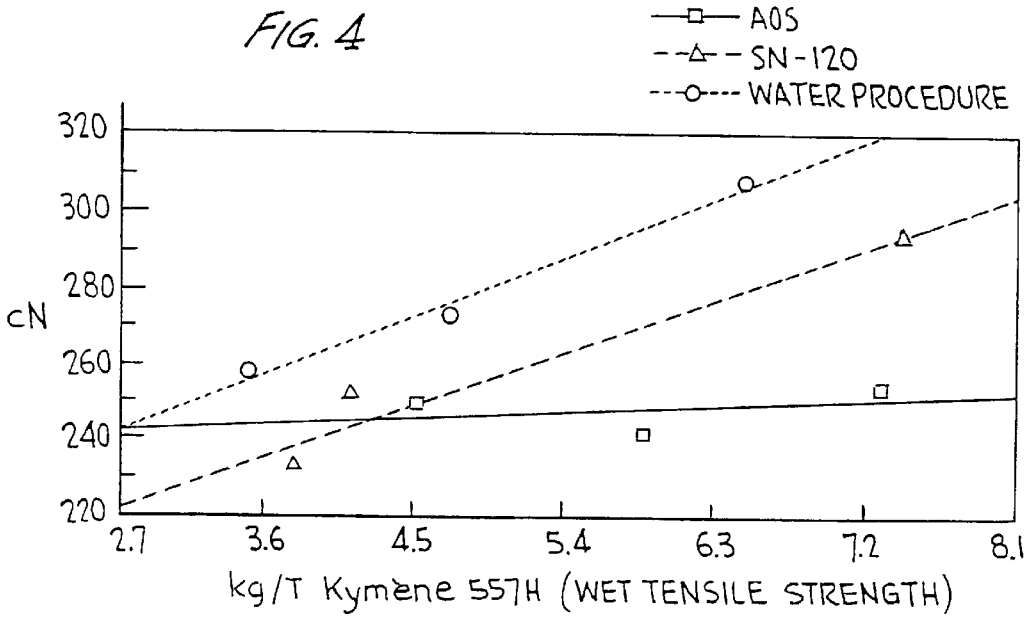
FIG. 4 shows a graph of the tensile strength (at rupture) in the wet state as a function of the amount of added cationic additive for various surfactants.

The curves of FIG. 4 show the moist strength as a function of added KYMENE® 557 H per ton of pulp for various surfactants. The wet strength function of the added quantity of KYMENE® 557 H of the method of the invention using WITCONOL® SN-120 is parallel to the wet strength of the water-medium procedure. Accordingly, the increase in strength of the method employing WITCONOL® SN-120 is similar to that of the water-medium procedure. On the other hand, KYMENE® 557 H offers no gain at all in wet strength in the procedure utilizing AOS.

Figure 5:
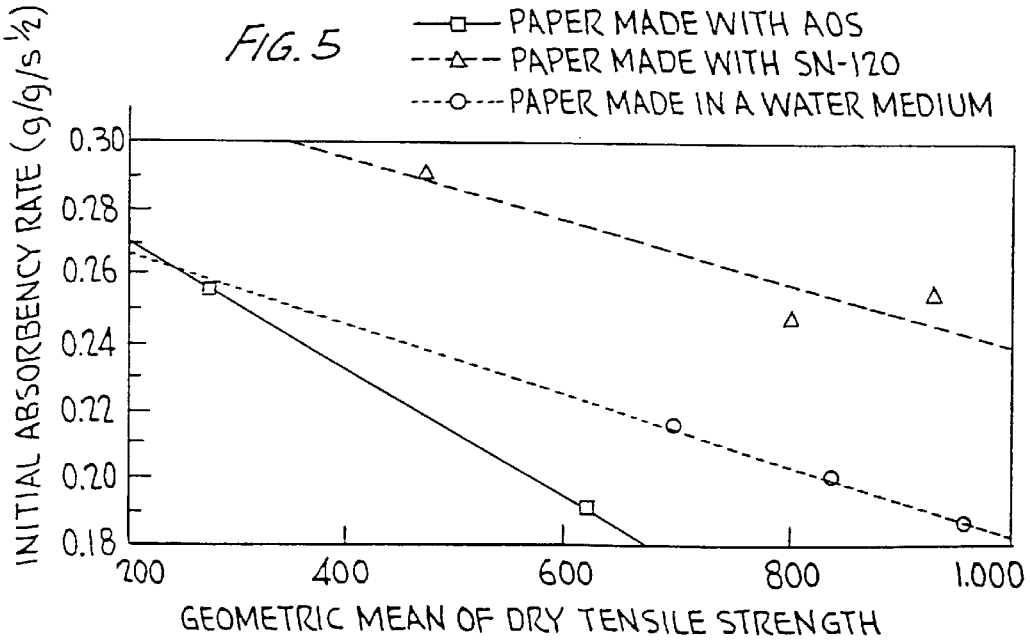
FIG. 5 shows a sheet's water-absorption rate for various surfactants.

The initial water-absorption rate also was compared when KYMENE® 557 H is present at a rate of 6 kg per ton of pulp. As shown by FIG. 5, which shows the initial rates of water absorption as a function of an average tension applied to a 2-ply sheet, such initial rate of water absorption is 25% higher for the WITCONOL® SN-120 prepared sheet than for the sheet prepared by the water-medium procedure.

The experiments run on the test apparatus, therefore, show that the foam-medium method of the invention using WITCONOL® SN-120 not only outperforms the AOS procedure but, furthermore, offers additional and unexpected advantages.

The method of the invention can also be implemented in another embodiment representing a variation of that carried out on the above described test apparatus.

FIG. 6 illustrates this second embodiment which is described in detail in U.S. Pat. No. 5,200,035. It differs from the first embodiment by the preparatory stages of the manufacturing composition fed into the boxhead.

The paper pulp from the pulp tower 100 is diluted in an aqueous solution and fed to a press 101. The press concentrates the paper mixture by eliminating the water. The concentrated mixture then moves into a needle shredder 102. The foaming liquid from a reservoir 103 also is fed into the shredder 102. A foaming fiber dispersion is formed thereby and is fed to a positive displacement pump 104 and from there to headbox 105. This procedure eliminates the treatment stage for the excess liquid recovered in the container and therefore allows elimination of the separation unit. Another consequence of this apparatus in carrying out the foam-medium method of the invention is to render the recovery unit more compact. Whereas generally six recovery units are mounted in cascade in the above-described first embodiment, in the second embodiment three foam recovery units suffice.

The method of the invention was industrially implemented using the above-described second embodiment. Several manufacturing parameters, such as consumption of surfactant, recovery of surfactant and the like, were measured and advantages observed.

Tests were run using WITCONOL® SN-120, more precisely a 80% active solution of WITCONOL® SN-120, i.e., the mixture sold as WITCONOL® SN-120D, for the method of the invention and AOS for the control procedure. The surfactant consumption was compared for WITCONOL® SN-120D and AOS. Table II below shows the results.

TABLE II

| | WITCONOL ® SN-120D (80% active solution) | AOS (control) (40% active solution) | | |
|---|---|---|---|---|
| | | Test 1 | Test 2 | Test 3 |
| Consumption of pure surfactant (kg/h) | 0.9 | 2.35 | 2.41 | 2.5 |
| Air content (%) | 57.6 | 57.1 | 57.3 | 57.5 |

Table II shows an advantageous feature of the invention. The consumption of the Formula I surfactant, in this instance WITCONOL® SN-120D, to keep the air proportion within the desired range, is lower than the consumption of AOS. Because of the lower consumption of surfactant as regards WITCONOL® SN-120D, the loading at the input of the recovery unit is also much lower.

The recovery of the WITCONOL® SN-120D surfactant was measured and compared with the recovery of AOS. The test results are summarized in Table III for similar air contents.

TABLE III

| | WITCONOL ® SN-120D (80% active solution) | AOS (40% active solution) | | |
|---|---|---|---|---|
| | | TEST 1 | TEST 2 | TEST 3 |
| Consumption in pure surfactant (kg/h) | 0.9 | 2.35 | 2.41 | 2.5 |
| Recovery of surfactant ($m^3$/h) | 4.9 | 5.5 | 6.1 | 5.3 |
| Content in air, (%) | 57.6 | 57.1 | 57.3 | 57.5 |

It follows from Table III that for equal consumption of surfactant, WITCONOL® SN-120D recovery is significantly higher than of AOS under equal circumstances. Considering this advantageous surfactant recovery, one might also advantageously eliminate one of the three recovery units.

The water recovered at the exit of the recovery units evinces a lower concentration in surfactant, such as WITCONOL® SN-120D, and at most 3 ppm approximately, and thus can be discarded or re-used, lacking by now any foaming characteristic. This is an important feature considering ecological laws.

The residual surfactant concentration in the sheet of paper drops by 65% for WITCONOL® SN-120D as compared with the concentration of products made with AOS. Furthermore, when BEROL is incorporated into the pulp in the course of manufacture, the assigned quantity of this component in the sheet made by the foaming procedure in the manner of the invention is identical with that assigned to a sheet made by the water-medium procedure.

Moreover, it was found that substituting WITCONOL® SN-120D for AOS and vice versa in the manufacturing procedure will not cause technical problems.

Lastly, the paper-sheet properties were measured on toilet paper made by the method of the invention using WITCONOL® SN-120D and, where called for, including the softener BEROL. These paper sheets were made in an industrial manner using the above-described second implementation embodiment of the invention.

Softness was ascertained by physical measurement and at the same time by a panel of experts. A finished sheet of paper, i.e., a transformed sheet, which by this test evinces good softness, is assigned a value which must fall between 90 and 95. The sheets from the mother reels prior to transformation and made by the method of the invention using WITCONOL® SN-120D evince a high softness value of 92 to 96. Once transformed, the sheets evince improved softness values of between 96 and 100. When BEROL is incorporated into the pulp, the sheet made by the method of the invention evinces even higher softness that can exceed 100 for the mother reels and the transformed product.

The present invention is not restricted to the implementing embodiments described above, but also includes all technical equivalents within the art of the expert.

What is claimed is:

1. A manufacturing method in a foam medium for a sheet of paper or non-woven comprising employing a surfactant to form the foam, the surfactant being a nonionic compound of an ethoxylated alcohol type having a formula:

$$R—(OCH_2CH_2)_n—OH$$

wherein n is an integer from 2 to 22 and R is a linear or branched alkyl group having from 6 to 20 carbon atoms.

2. Method defined in claim 1 wherein n has a value of between 4 and 20 and R is a linear alkyl group having 8 to 16 carbon atoms.

3. A manufacturing method in a foam medium for a sheet of paper or non-woven comprising employing a surfactant to form the foam, the surfactant being a nonionic compound of an ethoxylated alcohol type having a formula:

$$R—(OCH_2CH_2)_n—OH$$

wherein n is an integer from 2 to 22 and R is a linear or branched alkyl group having from 6 to 20 carbon atoms, and incorporating at least one cationic additive for papermaking.

4. Method defined in claim 3 wherein said at least one cationic additive is selected from the group consisting of substances improving wet strength and substances improving dry strength.

5. Method defined in claim 4 wherein said substances improving wet strength are quaternary polyamines.

6. Method defined in claim 3 wherein said at least one cationic additive is a softener.

7. The method of claim 6 wherein the cationic softeners have the following formula:

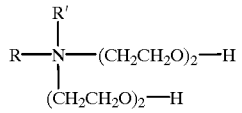

wherein R and R' are alkyl groups having 10 to 14 carbon atoms.

8. The method of claim 4 wherein the cationic wet strength additives are polycationic.

9. The method of claim 4 wherein the cationic dry strength additives are quaternary cationic starch ethers.

* * * * *